US006821018B1

(12) United States Patent
Denko

(10) Patent No.: US 6,821,018 B1
(45) Date of Patent: Nov. 23, 2004

(54) FLEXIBLE CONTAINER WITH A SEALABLE CLOSURE

(76) Inventor: Jacques Denko, Residence les Cigalons, 19 avenue des Coccinelles, 13012, Marseilles (FR)

( * ) Notice: Subject to any disclaimer, the term of this patent is extended or adjusted under 35 U.S.C. 154(b) by 0 days.

(21) Appl. No.: 09/926,546

(22) PCT Filed: May 19, 2000

(86) PCT No.: PCT/FR00/01361

§ 371 (c)(1),
(2), (4) Date: Apr. 19, 2002

(87) PCT Pub. No.: WO00/70993

PCT Pub. Date: Nov. 30, 2000

(30) Foreign Application Priority Data

May 20, 1999 (FR) ..... 99 06601

(51) Int. Cl.[7] ..... B55D 33/16

(52) U.S. Cl. ..... 383/59; 206/811; 383/61.1; 383/84; 383/86

(58) Field of Search ..... 383/59, 61.1, 78, 383/81, 84, 86, 60, 68; 206/811; 24/30.5 R

(56) References Cited

U.S. PATENT DOCUMENTS

| | | | | | |
|---|---|---|---|---|---|
| 285,908 | A | * | 10/1883 | Ludington | 383/68 |
| 302,920 | A | * | 8/1884 | Ludington | 383/68 |
| 580,888 | A | * | 4/1897 | Ort | 383/31 |
| 593,346 | A | * | 11/1897 | Baehn | 383/22 |
| 1,142,509 | A | * | 6/1915 | Ellman et al. | 2/251 |
| 1,219,232 | A | * | 3/1917 | Blumberg | 383/22 |
| 1,566,867 | A | * | 12/1925 | Hetzer et al. | 383/6 |
| 1,712,109 | A | * | 5/1929 | Hammer | 383/59 |
| 1,792,117 | A | * | 2/1931 | Paull | 2/253 |
| 1,820,582 | A | | 8/1931 | Strayer | |
| 1,837,918 | A | | 12/1931 | Neves et al. | |
| 2,055,695 | A | * | 9/1936 | MacDonald | 383/68 |
| 2,093,345 | A | * | 9/1937 | Wesolowski | 224/182 |
| 2,500,363 | A | * | 3/1950 | Koeppel | 383/59 |
| 2,521,047 | A | * | 9/1950 | Davis | 2/252 |
| 2,606,587 | A | * | 8/1952 | Porter | 383/68 |
| 2,622,647 | A | * | 12/1952 | Arnthal | 150/118 |
| 2,709,815 | A | * | 6/1955 | Nelson | 2/247 |
| 2,962,070 | A | * | 11/1960 | Towles | 383/59 |
| 3,727,829 | A | * | 4/1973 | Huni | 383/203 |
| 3,797,733 | A | * | 3/1974 | Ibing | 383/119 |
| 5,428,871 | A | * | 7/1995 | Iosif | 24/30.5 R |
| 5,797,683 | A | * | 8/1998 | Gunzi et al. | 383/68 |
| 5,957,583 | A | * | 9/1999 | DeClements et al. | 383/3 |

FOREIGN PATENT DOCUMENTS

| | | | | |
|---|---|---|---|---|
| CH | 171901 | | 9/1934 | |
| DE | 98041 | * | 9/1924 | 383/68 |
| DE | 814027 | | 9/1951 | |
| DE | 3138510 | * | 4/1983 | |
| DE | 8914714 | | 2/1990 | |
| DE | 29722646 | | 5/1998 | |
| FR | 1280724 | | 5/1962 | |
| FR | 2005025 | | 12/1969 | |
| FR | 2513864 | | 4/1983 | |
| FR | 2517183 | | 6/1983 | |
| FR | 2760949 | | 9/1998 | |
| FR | 2760950 | | 9/1998 | |

* cited by examiner

*Primary Examiner*—Joseph C. Merek
(74) *Attorney, Agent, or Firm*—Greenblum & Bernstein, P.L.C.

(57) ABSTRACT

Flexible container with a sealable closure system comprising an envelope type enclosure having impermeable walls, an opening being defined at an upper portion of the enclosure, two rigid bars being configured to tightly engage edges of the opening in order to seal the enclosure closed, at least one of the two rigid bars being movable, and a system for locking the two rigid bars together. The system for locking the two rigid bars together engages the two rigid bars at both ends of the rigid bars.

21 Claims, 1 Drawing Sheet

FLEXIBLE CONTAINER WITH A SEALABLE CLOSURE

CROSS-REFERENCE TO RELATED APPLICATIONS

The present application is a National Stage Application of International Application No. PCT/FR00/01361, filed May 19, 2000. Further, the present application claims priority under 35 U.S.C. §119 of French Patent Application No. 99/06601 filed on May 20, 1999.

BACKGROUND OF THE INVENTION

1. Field of the Invention

The present invention relates to a flexible container with a sealable closure.

It is particularly adapted to bathers who wish to keep their valuables with them when they engage in nautical activities such as swimming, diving, windsurfing, or the like, but can lend itself to numerous applications in a number of fields whenever a sealed envelope which can be opened and closed as often as possible is desired.

2. Discussion of Background Information

A large number of devices adapted to protect objects against water exist currently. In particular, belts comprising one or a plurality of waterproof compartments are known, but these are relatively expensive and cumbersome systems, the use of which can become generalized only with difficulty.

French Patents No. FR 2 513 864 and No. FR 2 517 183, filed by the Applicant, disclose a flattened flexible waterproof case comprising on one of its surfaces a cutout into which a rigid cover fits due to a groove arranged either on the periphery of this cutout, or on the periphery of the cover.

The necessity of having to insert the cover into the groove of the case, or the edges of the cutout into that of the cover makes the operations of opening and closing difficult, and the cover may be lost.

Moreover, since this type of device is adapted more specifically for use on the beach, there is a risk of grains of sand becoming lodged in the grooves, compromising the waterproofness of the unit.

Another patent, No. FR 2 760 949, filed by the same inventor, describes a flattened case that is waterproof, in particular to sea water, which opens by mere pressure on the side ends of the edges causing them to move apart, related to the protection of various objects, such as coins, bank notes, keys, identity papers against water, perspiration, sand, dust, etc., and comprising compressible joints arranged on the inner surface of the edges of the opening, arranged so as to make the case absolutely waterproof when no pressure is exerted, steel strips providing the closing force being incorporated between the walls of the case and the joints.

SUMMARY OF THE INVENTION

One of the objects of the present invention is to remedy this disadvantage. Indeed, it makes it possible to make bags or wallets of all types and sizes, with an absolutely waterproof closure.

The invention therefore provides for an envelope with impermeable walls, open at its upper portion and comprising two rigid parallel bars which can fit tightly around the edges of the opening in order to seal it, at least one of these bars being fixed to a closure flap of the envelope, a system for locking the envelope in a tight position is arranged at both ends of these bars.

The invention provides for a flexible container with a sealable closure, particularly adapted to bathers who wish to keep their valuables with them when they engage in nautical activities, but can lend itself to numerous applications in a number of fields whenever a sealed envelope which can be opened and closed as often as possible is desired, characterized in that it is constituted of an envelope with impermeable walls, open at its upper portion and comprising two rigid parallel bars which can fit tightly around the edges of the opening in order to seal it, at least one of these bars being movable, a system for locking in tight position being arranged at both ends of these bars.

The rigid bars may be mounted on a system of hinges or journalled arms guaranteeing a correct position before tightening. The device may include a closure flap of the envelope to which at least one of the rigid bars is fixed, the second rigid bar being capable of being fixed either to the flap, or to the rear outer surface of the wall of the envelope. The locking elements may be constituted of foldable tongues fixed to the flap or to the journal system of the rigid bars, and provided with cutouts confining the ends of the bars. The locking elements may be constituted of elastic lugs affixed to one of the rigid bars and locking on the second when it is sufficiently close. The inner surface of the edges of the opening may include at least one glued or fixed compressible joint, which is pressed against the second joint or against the opposite edge at the time of closure. of the envelope. The edges of the envelope may be stiffened by way of strips made of metal or synthetic materials. The device may be able to float due to a double wall filled with air or gas. The envelope may include lateral bellows. The device may include waterproof pockets on containers which themselves may or may not be waterproof.

The invention also provides for a flexible container with a sealable closure system comprising an envelope type enclosure having impermeable walls, an opening being defined at an upper portion of the enclosure, two rigid bars being configured to tightly engage edges of the opening in order to seal the enclosure closed, at least one of the two rigid bars being movable, and a system for locking the two rigid bars together, wherein the system for locking the two rigid bars together engages the two rigid bars at both ends of the rigid bars.

The flexible container may be adapted to store valuables in a nautical environment. The flexible container may be adapted to be opened and closed often. The two rigid bars may be arranged parallel to one another. Each of the two rigid bars may be movably mounted to the enclosure and are each configured to be correctly positioned adjacent an edge of the enclosure before tightening. The flexible container may further comprise a flap. At least one of the rigid bars may be coupled to the flap. The other of the two rigid bars may be coupled to one of the flap and an outer surface of one of the impermeable walls. The system for locking the two rigid bars together may comprise at least one of locking elements and foldable tongues. The system for locking the two rigid bars together may comprise foldable tongues, each foldable tongue having an opening that is sized to confine one end of each of the two rigid bars. The system for locking the two rigid bars together may comprise locking members, each locking member having an opening that is sized to confine one end of each of the two rigid bars. The system for locking the two rigid bars together may comprise elastic lugs, each elastic lug having a projection which releasably engages one end of at least one of the two rigid bars. The system for locking the two rigid bars together may comprise elastic lugs, each elastic lug having one end that is attached to one of the two rigid bars and another end which releasably engages one end of the other of the two rigid bars.

The flexible container may further comprise a compressible member arranged on an inner surface of at least one of the edges of the opening. The flexible container may further comprise a compressible member arranged on an inner surface of each of the edges of the opening. Each compressible member may be attached to the edges by one of gluing and fixing. The compressible members may be configured to movably engage each other when the enclosure is opened and closed. The compressible members may be arranged opposite one another.

The edges may be configured to be stiffened by strips made of a metal or a synthetic material. The flexible container may be adapted to at least one of trap air or gas and to float The impermeable walls may be deformable. The flexible container may further comprise a flap having a mechanism for releasably securing the flap on one of the impermeable walls.

The invention also provides for a flexible container with a sealable closure system comprising an envelope type enclosure having impermeable walls, an opening being defined at an upper portion of the enclosure, two rigid bars being configured to tightly engage edges of the opening in order to seal the enclosure closed, one of the two rigid bars being positioned against one of the impermeable walls when the enclosure is closed, another of the two rigid bars being positioned against another of the impermeable walls when the enclosure is closed, and a system for locking the two rigid bars together, wherein the system for locking the two rigid bars together engages the two rigid bars.

The invention still further provides for a flexible container with a sealable closure system comprising an envelope type enclosure having impermeable walls and a flap, an opening being defined at an upper portion of the enclosure, two rigid bars being configured to tightly engage edges of the opening in order to seal the enclosure closed, one of the two rigid bars being positioned against one of the impermeable walls when the enclosure is closed, another of the two rigid bars being positioned against another of the impermeable walls when the enclosure is closed, and a system for locking the two rigid bars together, wherein the system for locking the two rigid bars together engages the two rigid bars, wherein at least one of the rigid bars is coupled to the flap, and wherein the other of the two rigid bars is coupled to one of the flap and an outer surface of one of the impermeable walls.

BRIEF DESCRIPTION OF THE DRAWINGS

In the drawings, there is provided non-limiting examples of embodiments of the invention, in which.

DETAILED DESCRIPTION OF THE INVENTION

Figure 1:
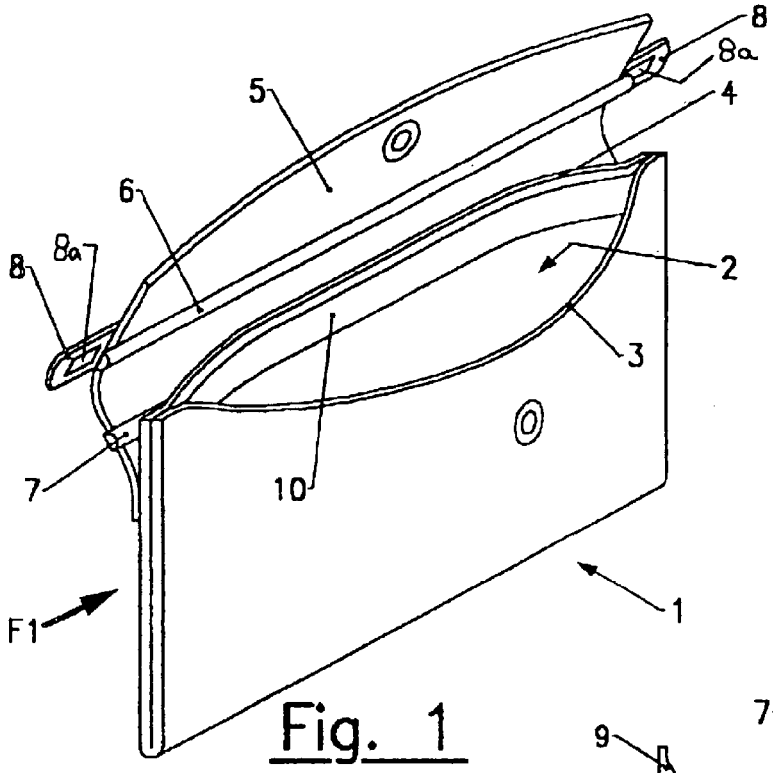
FIG. 1 shows an isometric perspective of an open wallet comprising only one sealing joint.
Figure 2:
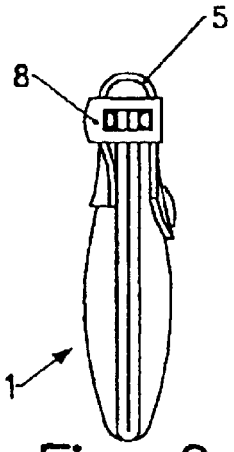
FIG. 2 shows an end view of the same wallet, closed along the arrow F1 of FIG. 1.
Figure 6:
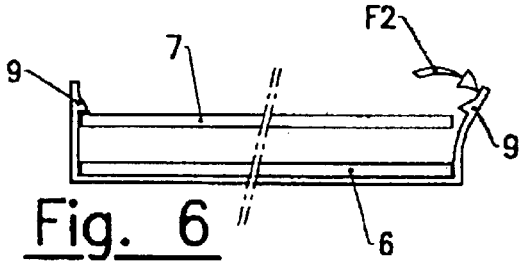
FIG. 6 shows a top view of an example of a locking system of the closure.
Figure 3:
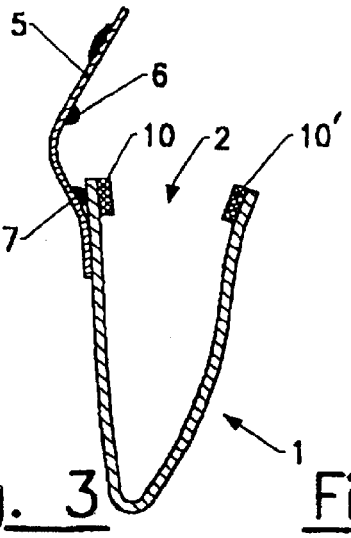
FIG. 3 is a transverse vertical cross-section of a wallet identical to that of FIG. 1, but comprising two sealing joints.
Figure 4:
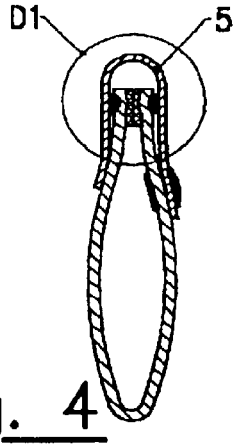
FIG. 4 shows the wallet of FIG. 3, closed, under the same conditions.
Figure 5:
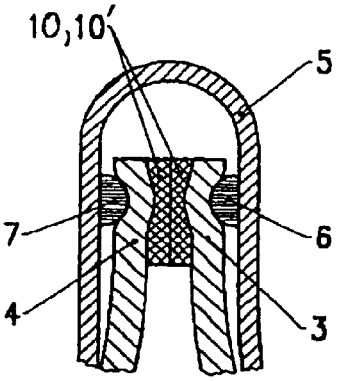
FIG. 5 is an enlargement of the detail D1 of FIG. 4.

The device shown in FIGS. 1–6 includes an envelope 1 comprising a top opening 2 formed of two edges joined at their ends, a front end 3 and a rear end 4, this opening 2 being capable of being closed by way of a flap 5 fixed to the rear wall of the envelope 1.

The opening 2 can be sealed by way of two rigid parallel bars 6, 7, made of metal or reinforced plastic, arranged so as to be able to compress the ends or edges 3, 4, against one another. The front bar 6 is movable and fixed to the inner surface of the flap 5 by any adequate methods, whereas the rear bar 7 can be fixed either to the flap 5, or to the rear outer surface of the rear wall of the envelope 1.

When the flap 5 is lifted, the front bar 6 is moved apart from the rear bar 7 and releases the opening 2 allowing access to the inside of the device 1. When it is folded back, the front bar 6 positions itself against the front edge 3 of the opening 2, facing the rear bar 7. The waterproofness is obtained by manually pressing the two bars 6, 7 against one another, and by maintaining them in this position due to locking elements arranged at the ends of these bars 6, 7. By way of example, these elements can be constituted of foldable tongues 8 fixed to the flap 5 and provided with cutouts 8*a* which are sized to confine the ends of the bars 6, 7. They can also be constituted of elastic lugs 9 affixed to one of the bars, e.g., 6, and locking on the second bar 7 when it is sufficiently close, the opening 2 occurring by pressing on the lug 9 to move it apart from the end of the bar 7 (arrow F2, FIG. 6). Any other system can also be used insofar as it fulfils the same functions. In particular, a lock device can be used.

The wall of the envelope 1 can be made out of any material or materials, but a waterproof material is preferable, such as flexible plastics, rubber, or elastomer. When the texture of the envelope wall does not make it possible to obtain a good waterproofness, one can provide on the inner surface of the edges 3 or 4 of the opening 2 at least one glued or fixed compressible joint 10, which is pressed against the second joint 10' or against the opposite edge at the time of closure of the envelope 1.

For large sized constructions, the edges 3, 4 of the envelope 1 can be stiffened by way of strips made of metal or synthetic material (not shown).

The container of the invention can be in numerous forms and sizes, from a wallet to a sea bag, handbag, backpack, school satchel. It can be used to obtain waterproof pockets on bags which themselves may or may not be waterproof, it can comprise lateral bellows or can be provided with a double wall filled with air or gas enabling the device to float.

It must be noted that the envelope 1 can be used as required with or without waterproofness, depending upon whether or not the locking systems 8, 9 are used.

The bars 6, 7 can possibly be mounted on a system of hinges or journalled arms guaranteeing a correct position before tightening. For certain alternative embodiments, this arrangement makes it possible to eliminate the flap 5, the locking systems 8, 9 being fixed in this case to these hinges or journalled arms.

The positioning of the various constituent elements gives the invention a maximum of useful effects which had not been previously obtained by similar devices.

What is claimed is:

1. A flexible container with a sealable closure system comprising:

an envelope enclosure having impermeable walls;

an opening being defined at an upper portion of the enclosure;

two rigid bars being configured to tightly engage edges of the opening in order to seal the enclosure closed;

each of the two rigid bars being fixed to a flap at different locations;

at least one of the two rigid bars being movable; and a system for locking the two rigid bars together, wherein the system for locking the two rigid bars together engages the two rigid bars at both ends of the two rigid bars, and wherein the two rigid bars are arranged opposite one another when the system for locking the two rigid bars together engages the two rigid bars at both ends of the rigid bars.

2. The flexible container of claim 1, wherein the flexible container is adapted to store valuables in a nautical environment.

3. The flexible container of claim 1, wherein the flexible container is adapted to be opened and closed often.

4. The flexible container of claim 1, wherein the two rigid bars are arranged parallel to one another.

5. The flexible container of claim 1, wherein each of the two rigid bars are movably mounted to the flap and are each configured to be correctly positioned adjacent an edge of the enclosure before tightening.

6. The flexible container of claim 1, wherein the system for locking the two rigid bars together comprises at least one of locking elements and foldable tongues.

7. The flexible container of claim 1, wherein the system for locking the two rigid bars together comprises foldable tongues, each foldable tongue having an opening that is sized to confine one end of each of the two rigid bars.

8. The flexible container of claim 1, wherein the system for locking the two rigid bars together comprises locking members, each locking member having an opening that is sized to confine one end of each of the two rigid bars.

9. The flexible container of claim 1, wherein the system for locking the two rigid bars together comprise elastic lugs, each elastic lug having a projection which releasably engages one end of at least one of the two rigid bars.

10. The flexible container of claim 1, wherein the system for locking the two rigid bars together comprise elastic lugs, each elastic lug having one end that is attached to one of the two rigid bars and another end which releasably engages one end the other of the two rigid bars.

11. The flexible container of claim 1, further comprising a compressible member arranged on an inner surface of at least one of the edges of the opening.

12. The flexible container of claim 1, further comprising a compressible member arranged on an inner surface of each of the edges of the opening.

13. The flexible container of claim 12, wherein each compressible member is attached to an edge by one of gluing and fixing.

14. The flexible container of claim 12, wherein the compressible members are configured to movably engage each other when the enclosure is opened and closed.

15. The flexible container of claim 12, wherein the compressible members are arranged opposite one another.

16. The flexible container of claim 1, wherein the edges are configured to be stiffened by strips made of a metal or a synthetic material.

17. The flexible container of claim 1, wherein the flexible container is adapted to at least one of trap air or gas and to float.

18. The flexible container of claim 1, wherein the impermeable walls are deformable.

19. The flexible container of claim 1, further comprising a mechanism for releasably securing the flap on one of the impermeable walls.

20. A flexible container with a sealable closure system comprising:

an envelope enclosure having impermeable walls;

an opening being defined at an upper portion of the enclosure;

two rigid bars being configured to tightly engage edges of the opening in order to seal the enclosure closed;

each of the two rigid bars being fixed to a flap at different locations;

one of the two rigid bars being positioned against one of the impermeable walls when the enclosure is closed;

another of the two rigid bars being positioned against another of the impermeable walls when the enclosure is closed; and a system for locking the two rigid bars together, wherein the system for locking the two rigid bars together engages the two rigid bars, and wherein the two rigid bars are arranged opposite one another when the system for locking the two rigid bars together engages the two rigid bars at both ends of the two rigid bars.

21. A flexible container with a sealable closure system comprising:

an envelope enclosure having impermeable walls and a movable flap;

an opening being defined at an upper portion of the enclosure;

two rigid bars being configured to tightly engage edges of the opening in order to seal the enclosure closed;

each of the two rigid bars being fixed to the movable flap at different locations;

one of the two rigid bars being positioned against one of the impermeable walls when the enclosure is closed;

another of the two rigid bars being positioned against another of the impermeable walls when the enclosure is closed; and a system for locking the two rigid bars together, wherein the system for locking the two rigid bars together engages the two rigid bars, wherein the two rigid bars are arranged opposite one another when the system for locking the two rigid bars together engages the two rigid bars at both ends of the two rigid bars.

* * * * *